US005367293A

United States Patent [19]

Howard et al.

[11] Patent Number: 5,367,293

[45] Date of Patent: Nov. 22, 1994

[54] MECHANICALLY ACTUATABLE ALARM DISABLE ASSEMBLY

[75] Inventors: Carol Z. Howard, Oxford; Thomas J. Batko, Wallingford, both of Conn.

[73] Assignee: Hubbell Incorporated, Orange, Conn.

[21] Appl. No.: 76,164

[22] Filed: Jun. 14, 1993

[51] Int. Cl.[5] ..... G08B 21/00

[52] U.S. Cl. ..... 340/687; 200/61.45 R; 340/693

[58] Field of Search ..... 340/687, 693; 200/61.45 R, 61.59, 51.15

[56] References Cited

U.S. PATENT DOCUMENTS

| | | | |
|---|---|---|---|
| 2,045,199 | 6/1936 | Petersen | 340/687 |
| 4,679,033 | 7/1987 | Hwang | 200/61.45 R |
| 4,764,762 | 8/1988 | Almour | 200/61.45 R |

*Primary Examiner*—John K. Peng
*Assistant Examiner*—Benjamin Lee
*Attorney, Agent, or Firm*—Jerry M. Presson; Michael R. Swartz

[57] ABSTRACT

A mechanically actuatable assembly for disabling an alarm device includes a guide housing positioned stationarily relative to the alarm device to be disabled and defining an interior guide passageway axially aligned with an active portion of the alarm device which functions in response to a predetermined interaction to disable the alarm device, an internal thread structure in the housing protruding into the interior guide passageway, and an elongated actuatable member having an external thread structure complementary to the internal thread structure and rotatably interfitted therewith such that the actuatable member is axially and rotatably movable relative to the housing and in opposite directions along the guide passageway between a reset position wherein the actuatable member is displaced from the active portion of the alarm device and an actuate position wherein the actuatable member interacts with the active portion of the alarm device to cause disabling of the same.

20 Claims, 2 Drawing Sheets

MECHANICALLY ACTUATABLE ALARM DISABLE ASSEMBLY

BACKGROUND OF THE INVENTION

1. Field of the Invention

The present invention generally relates to equipment having an alarm monitoring equipment operation and, more particularly, is concerned with a mechanically actuable assembly for disabling an alarm device.

2. Description of the Prior Art

It is common practice to install surge suppressor units on a wide variety of industrial, commercial and residential equipment for protecting the equipment from frequently-occurring utility power voltages spikes or surges. The surge suppressor unit prevents entry of voltage surges which could potentially damage the electrical components of the equipment. The effectiveness of the protection provided to the equipment by the surge suppressor unit depends on maintaining the surge suppressor unit in good operating condition.

Various devices have been provided to monitor proper functioning of a surge suppressor unit in order to alert an operator on a timely basis of malfunction or failure of the unit. One device is a light which either turns "on" (or "off" depending upon which condition is selected for use) when the surge suppressor unit malfunctions. However, a light will not draw the attention of a user unless the user inspects the light by looking at it. Another, more effective, device is an alarm, such as a buzzer, which will make an audible sound which can be heard by and thus catch the attention of the user or someone nearby.

Once attention of the user has been drawn to the defective surge suppressor unit and steps are being taken to obtain a replacement unit, the user typically desires a way to disable and silence the buzzer while awaiting the arrival and installation of the replacement unit. Consequently, a need exists to provide a means to easily and reliably disable the buzzer of a surge suppressor unit.

SUMMARY OF THE INVENTION

The present invention provides a mechanically actuable alarm disable assembly designed to satisfy the aforementioned needs. The alarm disable assembly of the present invention has features which makes disabling an alarm device easy to accomplish in a reliable manner without causing inadvertent disassembly of the disable assembly itself.

Accordingly, the present invention is directed to a mechanically actuatable assembly for disabling an alarm device. The alarm disable assembly comprises: (a) a guide housing positioned stationarily relative to and spaced from an alarm device to be disabled and defining an interior guide passageway axially aligned with an active portion of the alarm device which functions in response to a predetermined interaction to disable the alarm device; (b) an internal thread structure in the housing protruding into the interior guide passageway; and (c) an elongated actuatable member having an external thread structure complementary to the internal thread structure and rotatably interfitted therewith such that the actuatable member is rotatably and axially movable relative to the housing and in opposite directions along the guide passageway between a reset position wherein the actuatable member is displaced from the active portion of the alarm device and an actuate position wherein the actuatable member interacts with the active portion of the alarm to cause disabling of the alarm device.

More particularly, the internal thread structure includes at least one full turn of a thread having a helical configuration. The external thread structure includes a plurality of full turns of a thread having a helical configuration. Also, the external thread structure has a stop means defined thereon for limiting movement of the actuatable member away from the reset position in a direction away from actuate position so as to prevent removal of the actuatable member from the housing. The stop means is a shoulder surface defined on the external thread structure by a portion thereof having a different pitch than that of the remainder of the external thread structure.

Further, the guide housing has an elongated annular sidewall defining the interior guide passageway. The sidewall is cylindrical and has first and second open opposite ends, with the second end being closer to the active portion of the alarm device than the first end. The internal thread structure is integrally defined on the sidewall so as to protrude into the interior guide passageway.

Also, the actuatable member has an elongated shaft portion and a head portion attached on a first end of the shaft portion. The head portion is movable within the internal guide passageway relative to the sidewall between the opposite ends thereof. The shaft portion has a second opposite end interactable with the active portion of the alarm device to disable the same. The external thread structure is integrally defined about the shaft portion. The head portion of the actuatable member has a slot for receiving a tool to rotate the actuatable member.

These and other features and advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
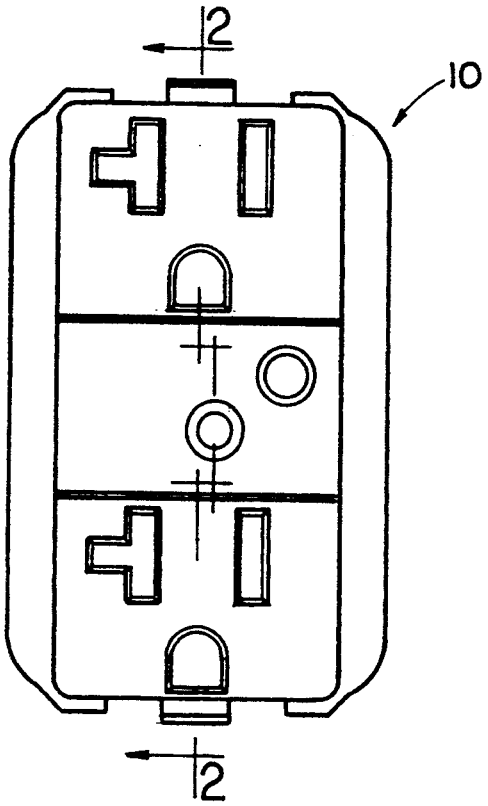
FIG. 1 is a top plan view of a surge suppressor unit which employs a mechanically actuatable alarm disable assembly of the present invention, with the actuating member of the alarm disable assembly not being present in FIG. 1.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 2:
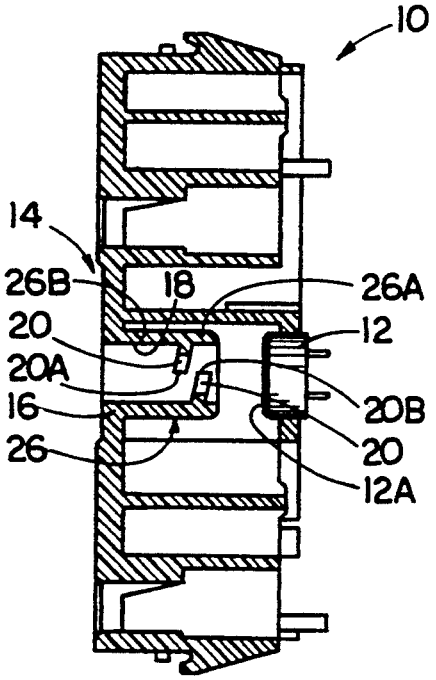
FIG. 2 is a longitudinal sectional view of the unit taken along line 2—2 of FIG. 1.

Referring now to the drawings, and particularly to FIGS. 1 and 2, there is illustrated a surge suppressor unit, generally designated 10, having a conventional alarm device 12 and incorporating a mechanically actuatable alarm disable assembly, generally designated 14, of the present invention. While the alarm disable assembly 14 is shown associated with a surge suppressor unit 10, it should be readily apparent that use of the alarm disable assembly 14 is not so limited; the alarm disable assembly 14 is applicable to many other kinds of equipment which employ alarm devices in order to create noises to alert an user monitoring the equipment or some other person nearby that attention should be directed to the equipment, for example, to rectify a malfunction of some kind. The function of the mechanical disable assembly 14 is to permit the user to disable or shutoff the alarm device 12.

Figure 3:
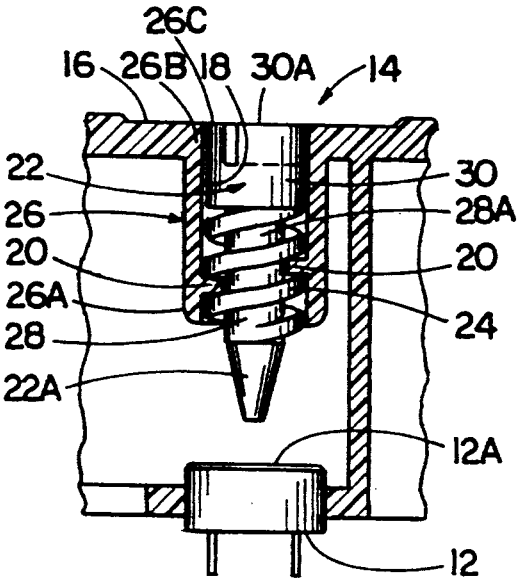
FIG. 3 is an enlarged fragmentary sectional view of the surge suppressor unit showing the actuating member of the alarm disable assembly in a raised, reset position.
Figure 4:
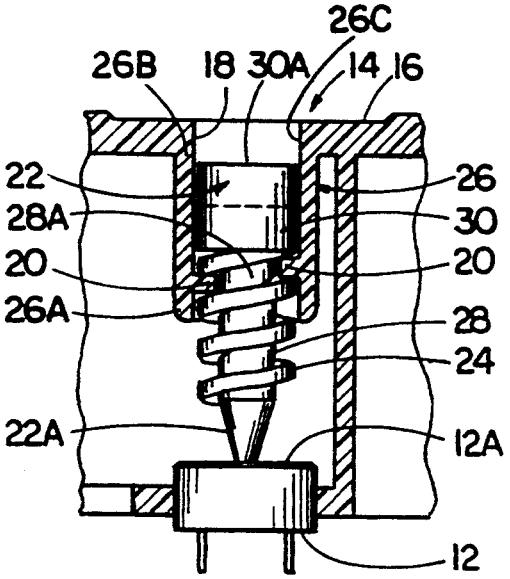
FIG. 4 is a view similar to that of FIG. 3, but showing the actuating member of the alarm disable assembly in a lowered, activated position.
Figure 7:
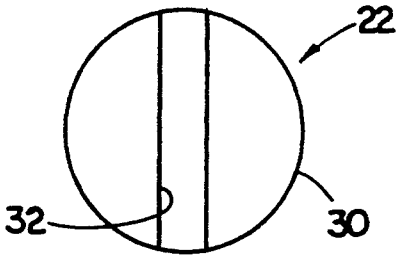
FIG. 7 is a top plan view of the actuating member as seen along line 7—7 of FIG. 5.
Figure 5:
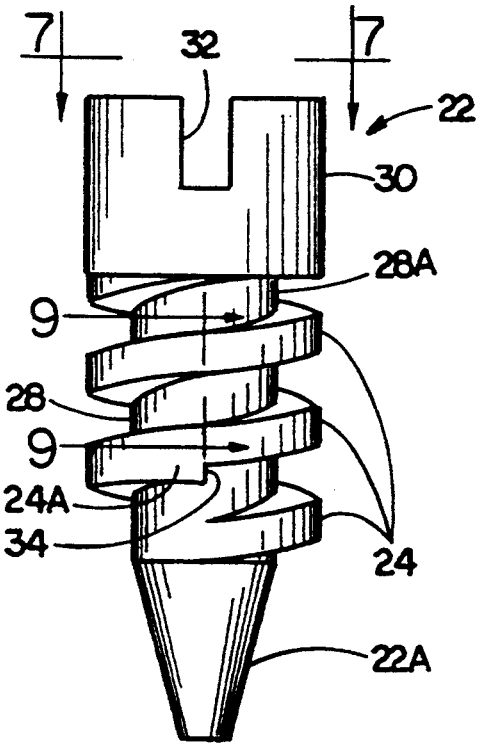
FIG. 5 is an enlarged side elevational view of the actuating member of the alarm disable assembly.
Figure 6:
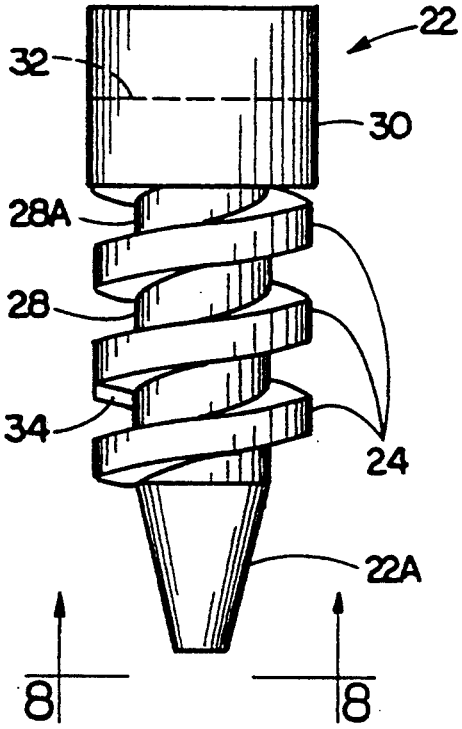
FIG. 6 is another enlarged side elevational view of the actuating member of the alarm disable assembly, with the member being rotated approximately 90° from its position in FIG. 5.
Figure 9:
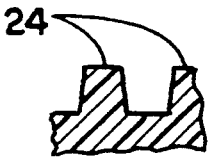
FIG. 9 is an enlarged fragmentary longitudinal sectional view of the thread on the actuating member taken along line 9—9 of FIG. 5.
Figure 8:
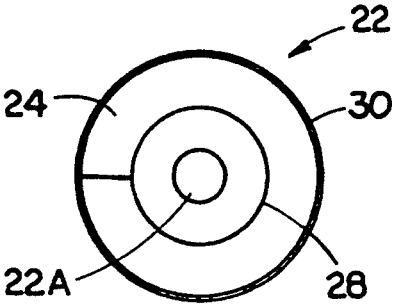
FIG. 8 is a bottom plan view of the actuating member as seen along line 8—8 of FIG. 6.

Referring to FIGS. 1–4, the alarm disable assembly 14 basically includes a guide housing 16 on the unit 10 positioned stationarily relative to and spaced from the alarm device 12 to be disabled and defining an interior guide passageway 18 axially aligned with an active portion 12A of the alarm device 12 which functions in response to a predetermined interaction to disable the alarm device 12, an internal thread structure 20 in the guide housing 16 protruding into the interior guide passageway 18, and an elongated actuatable member 22 (see FIGS. 3–9) having an external thread structure 24 complementary to the internal thread structure 20 and rotatably interfitted therewith such that the actuatable member 22 is rotatably and axially movable relative to the guide housing 16 and in opposite directions along the guide passageway 18 between a reset position, as shown in FIG. 3, wherein the actuatable member 22 is displaced from the active portion 12A of the alarm device 12 and an actuate position, as shown in FIG. 4, wherein the actuatable member 22 interacts with the active portion 12A of the alarm device 12 to cause disabling of the alarm device 12.

More particularly, the guide housing 16 has an elongated annular well-like sidewall 26 preferably cylindrical in configuration and defining the interior guide passageway 18 in axial alignment with the active portion 12A of the alarm device 12. The sidewall 26 of the guide housing 16 has a pair of open opposite ends 26A, 26B with the lower end 26A being closer to the active portion 12A of the alarm device 12 than the upper end 26B. The internal thread structure 20 is attached adjacent to the lower end 26A of the sidewall 26, leaving threadless a portion 26C of the sidewall 26 disposed above the internal thread structure 20 and extending therefrom to the upper end 26B of the sidewall 26.

In the illustrated example, the alarm device 12 is a buzzer and the active portion 12A of the device 12 is a metal diaphragm that vibrates and thereby makes a buzzing noise when the alarm device 12 is activated. The actuatable member 22 interacts with the metal diaphragm 12A by engaging it in a manner which stops its vibratory movement and the noise produced thereby. Other types of alarm devices 12 having a different type of active portion 12A could be employed to produce an alarm noise in some other way. With respect to such other alarm devices 12, the active portion 12A could be a contact type switch which is actuated by engagement with the actuatable member 22 or a non-contact type switch which senses the presence of the leading end 22A of the actuatable member 22 adjacent to it. In all instances, the active portion 12A functions upon interaction with the actuatable member 22 to disable the alarm device 12.

Referring to FIGS. 2–4, the internal thread structure 20 of the alarm disable assembly 14 is defined on the sidewall 26 of the guide housing 16 adjacent to the lower end 26A thereof where it protrudes into the interior guide passageway 18. Specifically, the internal thread structure 20 includes at least one full turn of a thread 20 having opposite beginning and ending faces 20A, 20B and a helical configuration.

Referring to FIGS. 3–8, the elongated actuatable member 22 of the alarm disable assembly 14 has an elongated shaft portion 28 and a head portion 30 of larger diameter size than the shaft portion 28 and being attached on an upper end 28A of the shaft portion 28. The head portion 30 has a transverse open slot 32 formed across its upper end 30A for receiving a tool (not shown) such as the tip of a screwdriver for rotating the actuatable member 22. The outside diameter of the head portion 30 is sufficiently smaller than the inside diameter of the sidewall 26 so as to allow the head portion 30 to be movably guided within the internal guide passageway 18 relative to the stationary sidewall 26 between the opposite upper and lower ends 26B, 26A thereof. The opposite end of the shaft portion 28 is the same as the leading end 22A of the actuatable member 22 which is interactable with the active portion 12A of the alarm device 12 to disable the same.

The external thread structure 24 of the actuatable member 22 includes a plurality of full turns of a thread 24 having a helical configuration and being integrally defined about the shaft portion 28. The external thread structure 24 is rotatably interfitted with the internal thread structure 20 on the housing sidewall 26. The guiding relationship established between the cylindrical head portion 30 of the actuatable member 22 and the cylindrical sidewall 26 of the guide housing 16 and the threaded relationship established between the internal thread structure 20 in the sidewall 26 and the external thread structure 24 about the shaft portion 28 of the actuatable member 22 ensure that the actuatable member 22 is maintained in alignment with the active portion 12A of the alarm device 12 as the member 22 is rotatably and axially moved relative to the housing sidewall 26 between the reset position of FIG. 3 and the actuate position of FIG. 4.

Also, the external thread structure 24 has a stop means 34 defined thereon located between the head portion 30 and the leading end 22A of the shaft portion 28 of the actuatable member 22 for limiting movement of the actuatable member 22 away from the reset position in a direction away from the actuate position so as to prevent withdrawal or removal of the actuatable member 22 from the housing sidewall 26. The stop means 34 is a shoulder surface 34 defined on the external thread structure 24 by a portion thereof 24A having a different pitch than that of the remainder of the external thread structure 24. The insertion of the actuatable member 22 toward the alarm device 12 is limited by a bottoming-out contact of the head portion 30 with the internal thread structure 20, as seen in FIG. 4.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. A mechanically actuatable assembly for disabling an alarm, comprising:

(a) a guide housing stationarily positioned relative to and spaced from an alarm to be disabled and defining an interior guide passageway axially aligned with an active portion of the alarm which functions in response to a predetermined interaction to disable the alarm;

(b) an internal thread structure in said housing protruding into said interior guide passageway; and (c) an elongated actuatable member having an external thread structure complementary to said internal thread structure and rotatably interfitted therewith such that said actuatable member is rotatably and axially movable relative to said housing and in opposite directions along said guide passageway between a reset position wherein said actuatable member is displaced from the active portion of the alarm and an actuate position wherein said actuatable member interacts with the active portion of the alarm to cause disabling of the alarm;

(d) said actuatable member having spaced opposite ends, said external thread structure being located on said actuatable member between said spaced opposite ends thereof and having a stop means defined thereon between and spaced from said spaced opposite ends of said actuatable member for limiting further movement of said actuatable member away from said and actuate position so as to prevent removal of said actuatable member from said housing.

2. The assembly as recited in claim 1, wherein said internal thread structure includes at least one full turn of a thread having a helical configuration.

3. The assembly as recited in claim 1, wherein said external thread structure includes a plurality of full turns of a thread having a helical configuration.

4. The assembly as recited in claim 1, wherein said external thread structure has a stop means defined thereon for limiting movement of said actuatable member away from said reset and actuate positions so as to prevent removal of said actuatable member from said housing.

5. The assembly as recited in claim 1, wherein said stop means is a shoulder surface defined on said external thread structure by a portion thereof having a different pitch than that of the remainder of said external thread structure.

6. The assembly as recited in claim 1, wherein said guide housing has an elongated annular sidewall defining said interior guide passageway.

7. The assembly as recited in claim 6, wherein said sidewall is cylindrical in configuration.

8. The assembly as recited in claim 6, wherein said sidewall has first and second open opposite ends, said second end being closer to the active portion of the alarm than said first end.

9. The assembly as recited in claim 6, wherein said internal thread structure is integrally defined on said sidewall so as to protrude into said interior guide passageway.

10. A mechanically actuatable assembly for disabling an alarm, comprising:

(a) a guide housing stationarily positioned relative to and spaced from an alarm to be disabled and defining an interior guide passageway axially aligned with an active portion of the alarm which functions in response to a predetermined interaction to disable the alarm;

(b) an internal thread structure in said housing protruding into said interior guide passageway; and (c) an elongated actuatable member having an external thread structure complementary to said internal thread structure and rotatably interfitted therewith such that said actuatable member is rotatably and axially movable relative to said housing and in opposite directions along said guide passageway between a reset position wherein said actuatable member is displaced from the active portion of the alarm and an actuate position wherein said actuatable member interacts with the active portion of the alarm to cause disabling of the alarm;

(d) said guide housing having an elongated annular sidewall defining said interior guide passageway and having first and second open opposite ends, said second end being located closer to the active portion of the alarm than said first end, said internal thread structure being attached to said sidewall adjacent to said second end thereof thereby leaving threadless portion of said sidewall disposed above said internal thread structure and extending therefrom to said first end of said sidewall;

(e) said actuatable member having an elongated shaft portion and a head portion attached on a first end of said shaft portion, said head portion being movable within said guide passageway relative to said sidewall along said threadless portion thereof, said shaft portion having said external thread structure attached thereon defining a threaded relationship with said internal thread structure on said sidewall, said shaft portion also having a second opposite end interacted with the active portion of the alarm to disable the alarm, said head portion of said actuatable member defining a guiding relationship with said threadless portion of said sidewall that, together with said threaded relationship of said external thread structure with said internal thread structure, maintains alignment of said actuatable member with the active portion of the alarm device as said actuatable member is rotatably and axially moved relative to said sidewall between said reset and actuate positions.

11. The assembly as recited in claim 10, wherein said external thread structure is integrally defined about said shaft portion.

12. A mechanically actuatable assembly for disabling an alarm, comprising:

(a) a guide housing having an elongated annular sidewall stationarily positioned relative to and spaced from an alarm to be disabled, said sidewall defining an interior guide passageway axially aligned with an active portion of the alarm which functions upon engagement to disable the alarm, said sidewall also having first and second open opposite ends with said second end being closer to the active portion of the alarm than said first end;

(b) an internal thread structure defined on said sidewall of said housing adjacent to said second end thereof so as to protrude into said interior guide passageway, said internal thread structure being attached to said sidewall adjacent to said second end thereof thereby leaving a threadless portion of said sidewall disposed above said internal thread structure and extending therefrom to said first end of said sidewall; and (c) an elongated actuatable member having an elongated shaft portion and a head portion attached on a first end of said shaft portion, said head portion being movable within said guide passageway relative to said sidewall between said first and second ends thereof, said shaft portion having a second opposite end being engaged with the active portion of the alarm to disable the alarm, said shaft portion also having an external thread structure defined thereabout rotatably interfitted in a threaded relationship with said internal thread structure on said housing sidewall such that said actuatable member is rotatably and axially movable relative to said housing sidewall between a reset position wherein said second end of said shaft portion is spaced from the active portion of the alarm and an actuated position wherein said second end of said shaft portion is engaged with the active portion of the alarm, said head portion of said actuatable member defining a guiding relationship with said threadless portion of said sidewall that, together with said threaded relationship of said external thread structure with said internal thread structure, maintains alignment of said actuatable member with the active portion of the alarm device as said actuatable member is rotatably and axially moved relative to said sidewall between said reset and actuate positions.

13. The assembly as recited in claim 12, wherein said internal thread structure includes at least one full turn of a thread having a helical configuration.

14. The assembly as recited in claim 12, wherein said external thread structure includes a plurality of full turns of a thread having a helical configuration.

15. A mechanically actuatable assembly for disabling an alarm, comprising:

(a) a guide housing having an elongated annular sidewall stationarily positioned relative to and spaced from an alarm to be disabled, said sidewall defining an interior guide passageway axially aligned with an active portion of the alarm which functions upon engagement to disable the alarm, said sidewall also having first and second open opposite ends with said second end being closer to the active portion of the alarm than said first end;

(b) an internal thread structure defined on said sidewall of said housing adjacent to said second end thereof so as to protrude into said interior guide passageway; and (c) an elongated actuatable member having an elongated shaft portion and a head portion attached on a first end of said shaft portion, said head portion being movable within said guide passageway relative to said sidewall between said first and second ends thereof, said shaft portion having a second opposite end being engaged with the active portion of the alarm to disable the alarm, said shaft portion also having an external thread structure defined thereabout rotatably interfitted with said internal thread structure on said housing sidewall such that said actuatable member is rotatably and axially movable relative to said housing sidewall between a reset position wherein said second end of said shaft portion is spaced from the active portion of the alarm and an actuated position wherein said second end of said shaft portion is engaged with the active portion of the alarm;

(d) said actuatable member having spaced opposite ends, said external thread structure being located on said actuatable member between said spaced opposite ends thereof and having a stop means defined thereon between and spaced from said spaced opposite ends of said actuatable member for limiting further movement of said actuatable member away from said actuate position so as to prevent removal of said actuatable member from said housing.

16. The assembly as recited in claim 15, wherein said stop means is a shoulder surface defined on said external thread structure by a portion thereof having a different pitch than that of the remainder of said external thread structure.

17. The assembly as recited in claim 12, wherein said sidewall is cylindrical in configuration.

18. The assembly as recited in claim 12, wherein said internal thread structure is integrally defined on said sidewall so as to protrude into said interior guide passageway.

19. The assembly as recited in claim 18, wherein said external thread structure is integrally defined about said shaft portion.

20. The assembly as recited in claim 12, wherein said head portion of said actuatable member has a slot for receiving a tool to rotate said actuatable member.

* * * * *